US005722856A

United States Patent [19]

Fuchs et al.

[11] Patent Number: 5,722,856

[45] Date of Patent: Mar. 3, 1998

[54] APPARATUS FOR ELECTRICAL CONNECTION OF A COAXIAL CABLE AND A CONNECTOR

[75] Inventors: Josef Fuchs, Appenzell; Ulf Hugel, Herisau, both of Switzerland

[73] Assignee: Huber+Suhner AG, Herisau, Switzerland

[21] Appl. No.: 590,521

[22] Filed: Jan. 24, 1996

[30] Foreign Application Priority Data

May 2, 1995 [CH] Switzerland ..... 1248/95

[51] Int. Cl.[6] ..... H01R 9/05

[52] U.S. Cl. ..... 439/578; 439/33

[58] Field of Search ..... 439/578, 580, 439/583, 584, 585, 427, 824, 700, 33

[56] References Cited

U.S. PATENT DOCUMENTS

| | | | |
|---|---|---|---|
| 3,106,599 | 10/1963 | Leitner et al. . | |
| 3,275,970 | 9/1966 | Johanson et al. | 439/578 |
| 4,307,928 | 12/1981 | Petlock, Jr. | 439/824 |
| 5,137,470 | 8/1992 | Doles | 439/578 |

FOREIGN PATENT DOCUMENTS

| | | |
|---|---|---|
| 0551092A3 | 7/1993 | European Pat. Off. . |
| 1593189 | 7/1970 | France . |
| 864910 | 4/1961 | United Kingdom . |

*Primary Examiner*—Neil Abrams
*Assistant Examiner*—Christopher Goins
*Attorney, Agent, or Firm*—Sughrue, Mion, Zinn, Macpeak & Seas, PLLC

[57] ABSTRACT

An apparatus for electrical connection of one end of a conductor (5) of a coaxial cable (1) with a conductor (14) of a coaxial connector (6). A spring-like, bellows-shaped intermediate piece (25) is compressed between the conductor (5) at one end and the conductor (14) of the coaxial connector (6) at the opposite end. The intermediate piece prevents temperature changes and mechanical effects from adversely affecting the stability of the connection.

13 Claims, 3 Drawing Sheets

APPARATUS FOR ELECTRICAL CONNECTION OF A COAXIAL CABLE AND A CONNECTOR

FIELD OF THE INVENTION

The invention relates to an apparatus for electrical connection of a hollow conductor of a coaxial cable with a conductor of a coaxial connector.

BACKGROUND OF THE INVENTION

An apparatus of this general type is well known, for example, from EP-A-0551092. To lock the coaxial cable to the coaxial connector, the cable is split at the end to be connected. To connect the inner separated lead with the inner lead of the coaxial connector, a spring seat is arranged in the coaxial connector which is pushed onto a tap inserted in the inner connector. In practice, it is seen that, in the high frequency region, the site of the spring seat connection with the inner conductor of the coaxial cable is often a center of disturbance and the properties of this connection site can change with the insertion depth of the spring seat. Further, temperature changes as well as mechanical effects can influence the stability of the connection between the two inner conductors.

The objective of this invention is to create an apparatus of the general type identified above which minimizes the cited disadvantages while still allowing a simple installation of the coaxial connector. The apparatus should be suited for various coaxial cables and also for various coaxial connectors. In addition, the apparatus should ensure, more reliably than before, that electric data are preserved unchanged under a multitude of mechanical and climatic influences.

These objectives are met by a general type of apparatus having a bellows-type intermediate piece, which intermediate piece is connected spring-wise with the conductor of the coaxial cable and with the conductor of the coaxial connector. The intermediate piece can lie directly on the separated end of the conductor, which is spread out preferably in a funnel shape. According to a further development of the invention, the conductor of the coaxial cable has a contact part which is engaged in the hollow space of the conductor and lies against the intermediate piece. The contact surface of the contact part is preferably conical or funnel-shaped. This part can, for example, be anchored in the hollow space of the conductor and seal the hollow space.

The current in the high frequency region is conducted essentially on the surface of the conducting parts, and with a bellows-shaped intermediate piece, a change in the curvature and separation of the peaks and valleys of the bellows when the bellows is expanded or contracted has a considerably smaller influence on the surge impedance than a change of the insertion depth of a spring seat. The elasticity of the intermediate piece can be comparatively small and lie, for example, in the range of a few millimeters of expansion/contraction. The intermediate piece is compressed in the axial direction at installation of the coaxial connector and is elastic at least to the extent of a few millimeters in the compressed state. The apparatus according to the invention facilitates an installation with common coaxial connectors and requires no soldering work or otherwise extensive processing steps. Further, since the intermediate piece can be bent perpendicular to its axial direction, geometric defect locations rarely influence the electric contact.

The invention likewise pertains to a coaxial connector with a coaxial cable locked onto it with a hollow inner conductor, for example, which is connected conductively with a female connector or a contact pin of the coaxial connector. To accommodate the above objective, an intermediate bellows-shaped piece is compressed in the axial direction with one of its ends contacting the inner conductor of the coaxial cable in a spring fashion. The compressed intermediate piece lies spring-wise under compression against the inner conductor of the coaxial cable. Length changes or shifts resulting from mechanical influences are absorbed by the elasticity of the intermediate piece. Changes in curvature and separation of the peaks and valleys of this bellows-shaped intermediate piece have very little influence on the surge impedance and thus ensure high stability.

DETAILED DESCRIPTION OF THE PREFERRED EMBODIMENTS

Figure 1:
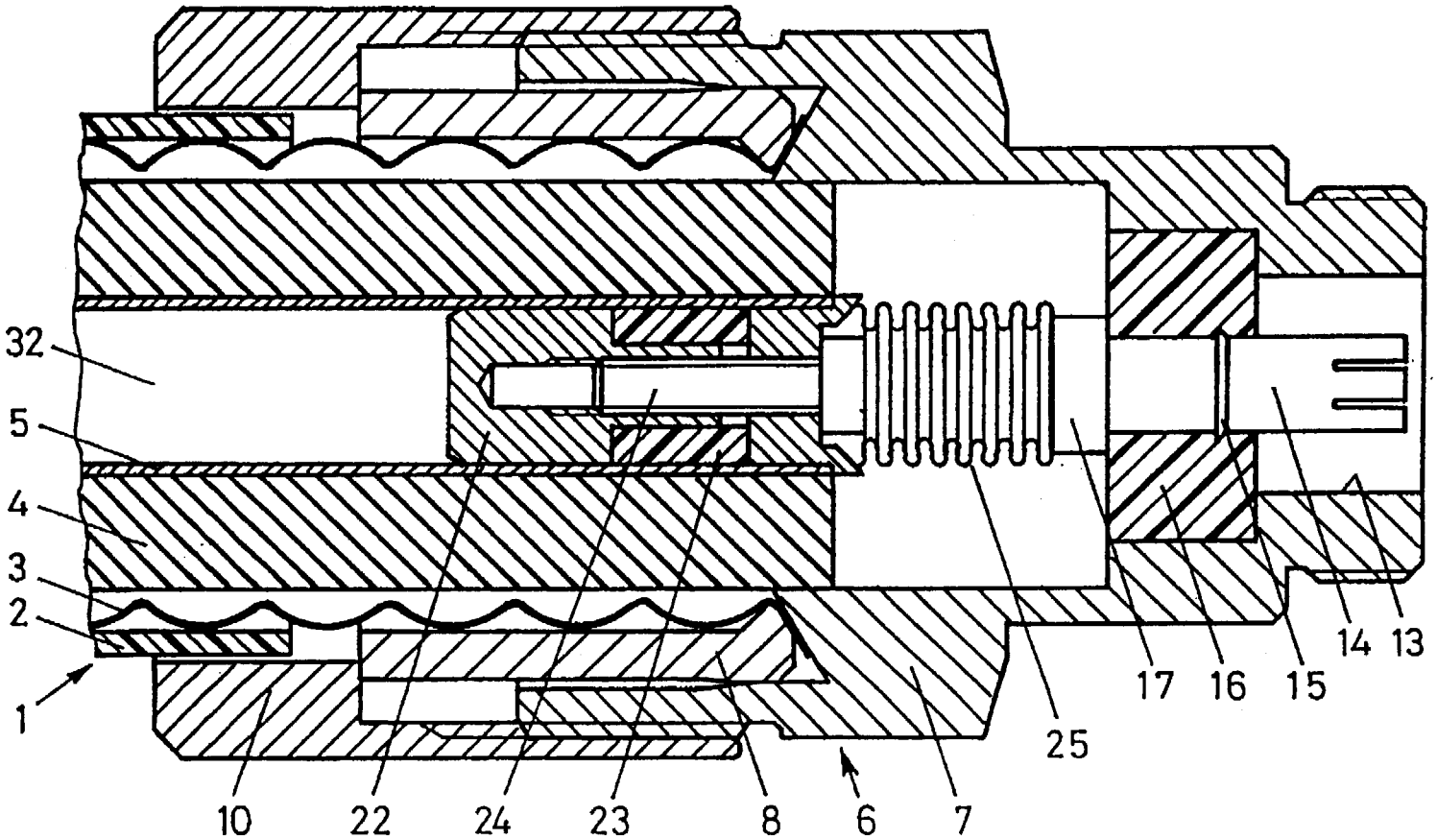
FIG. 1 is an axial section through a coaxial connector and an end of a coaxial cable.

FIG. 1 shows an end of a common coaxial cable 1, which has an outer insulating cover 2, a corrugated tube 3 as the outer conductor, a dielectric 4, and a preferably hollow inner conductor 5. The coaxial cable 1 is preferably a high frequency cable.

Figure 2:
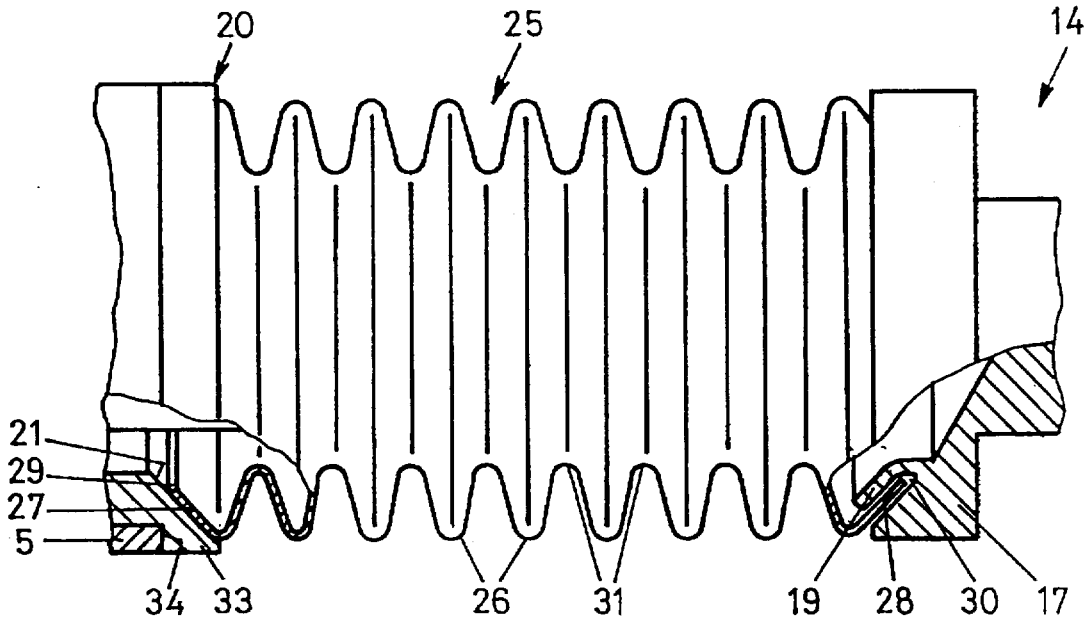
FIG. 2 is a partially sectioned view of an apparatus according to the invention.

A coaxial connector 6 attached to the cable 1 includes a housing 7 in which a jacket 8 is disposed. The connector is fastened with a nut 10 to fix the corrugated tube 3 to the housing 7. An inner conductor 14 is fixed in a cylindrical bore 13 of the housing 7 by a dielectric holder 16. Axial movement of the inner conductor 14 in the holder 16 is prevented by a radially projecting collar 15. The inner conductor 14 is constructed, as seen, on one end as a spring seat and it can accommodate a contact pin, not shown. On the inner side of holder 16 the inner conductor 14 has a radial flange 17 onto which a bellows-shaped intermediate piece 25 is fastened. An outwardly bent pinch collar 19 is built into the flange 17 as shown in FIG. 2. A circular end 28 of the intermediate piece 25, bent inwardly, is fixed to a conical contact surface 30 of the flange 17 by the pinch collar 19. The intermediate piece 25 is thus solidly connected to the inner conductor 14 and is safely supported by it.

The other end of the intermediate piece 25 has an inwardly directed edge 27, which defines a circular opening 29. The intermediate piece is hollow throughout between the two edges 28 and 27, and is constructed rotationally symmetric. Its peripheral corrugation peaks 26 alternate with corrugation valleys 31. An embodiment is conceivable as well, however, in which the corrugation peaks 26 and valleys 31 have another form than that shown, or are arranged spirally.

The intermediate piece 25 is preferably made of one piece and is produced from a comparably thin-walled pipe. In its axial direction, the intermediate piece acts like a spring and can be shortened in the axial direction by compression, for example from a total length of 20 mm to 16 mm. In this shortened or compressed condition, the intermediate piece 25 can be further shortened or compressed by, for example, 2–3 mm. Suitable materials for production of the intermediate piece 25 are, for example, copper-beryllium alloys or steel alloys. Other materials are also conceivable, such as conducting synthetic materials. FIG. 1 shows the intermediate piece 25 in the compressed condition. The circular edge 27 abuts a conical contact surface 21 of a contact part 20 and is held there under elastic compression. The contact part 20 is disposed in a hollow space 32 of the inner conductor 5, and a shoulder 33 of the contact part overlaps a sectional surface 34 of one end of the inner conductor 5. A spreading collar 23 is located between the contact part 20 and an anchor 22, and is held under tension by a screw 24. The hollow space 32 is sealed by the shoulder 33, the anchor 22, and the spreading collar 23.

If the distance between the contact surface 21 and the flange 17 changes, for example as a result of thermal length changes or mechanical effects, the intermediate piece 25 is either shortened against its oppositely directed spring force or is lengthened as a result of its spring effect. The length changes at the intermediate piece 25 are very small, however, as a rule, typically less than 1 mm. Eccentricities in the axes of the coaxial cable 1 and the coaxial connector 6 are also absorbed by the corresponding spring effect of the intermediate piece 25. The intermediate piece 25 is compressed when the housing 7 is installed on the coaxial cable 1. As the length of the intermediate piece 25 changes, the distances between the corrugated peaks and valleys change, but not the contact locations.

Figure 3:
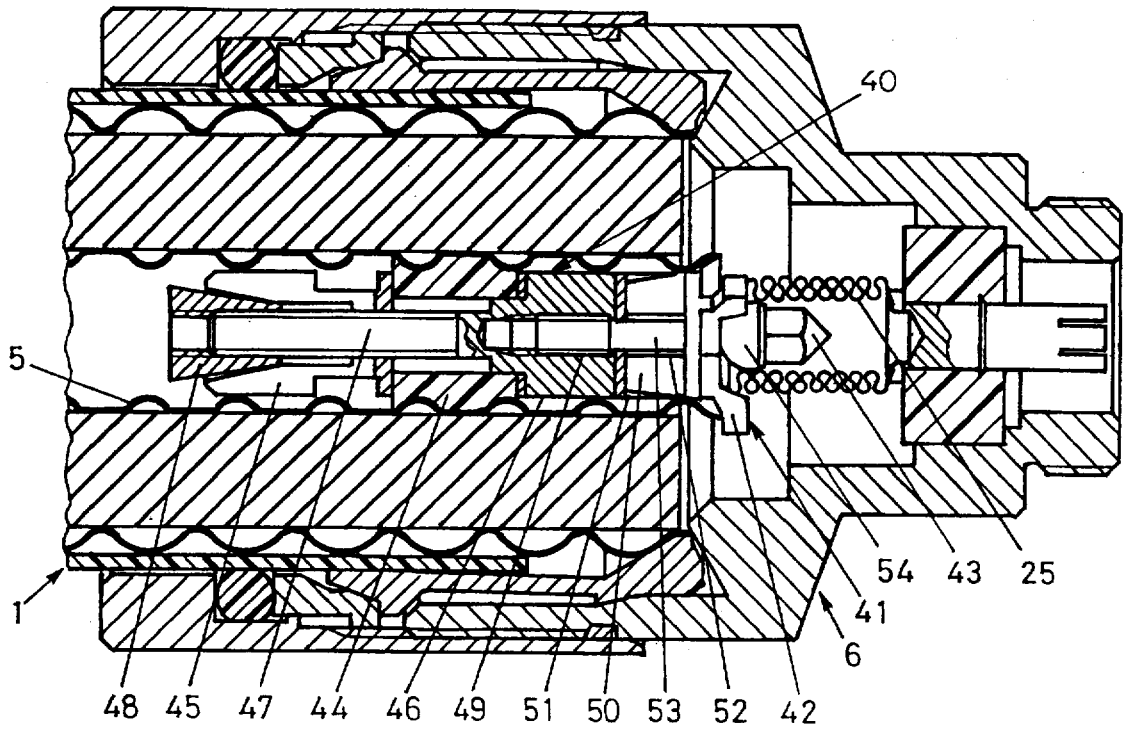
FIG. 3 is an axial section through a variation of the apparatus according to the invention.
Figure 4:
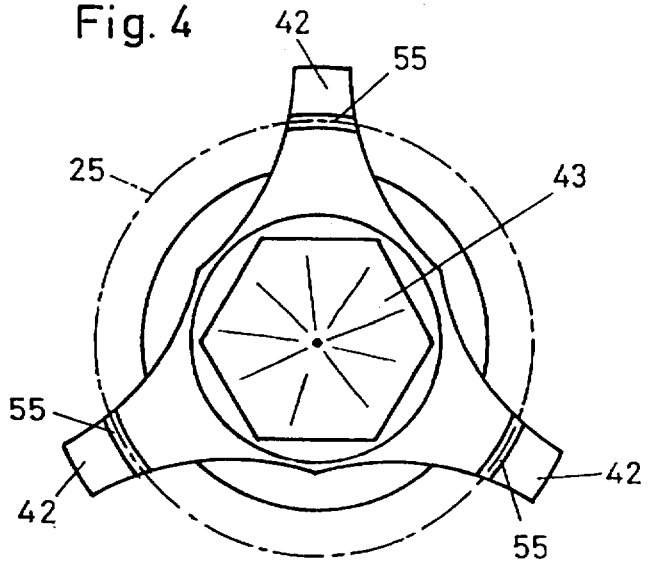
FIG. 4 is a view of a portion of the apparatus according to FIG. 3.

In the illustrated example, the intermediate piece 25 connects two inner conductors. An embodiment is conceivable, however, in which the intermediate piece 25 connects two outer conductors together. The example shown in FIGS. 3 and 4 differs from the one mentioned above by virtue of a tap 40 which is inserted removably in the inner conductor 5 and against which the bellows-shaped intermediate piece 25 is abutted under spring tension. The tap 40 contains a hollow cylindrical sealing part 44 made of, for example, silicone rubber, which is arranged under axial pressure between a swaging collar 45, with an exterior edge, and a connector 46. A threaded rod 47 is attached to the connector 46, and the rod holds a swaging cone 48 in swaging collar 45 which spread radially against the inner conductor 5. The axial hold and the seal of the tap 40 are facilitated by raised portions of the inner conductor 5, although the raised portions are not required, i.e., the inner conductor 5 may be smooth.

On the end extending out from the inner conductor of the tap 40, a crown-shaped contact part 41 is movably installed with a tightening screw 43. The screw 43 engages an axial threaded bore 49 of the connector 46. The contact part 41 is engaged in a slot 51 of the connector 46 with a forked seat 50 with radial play and receives the shaft 53 of the tightening screw 43 in an axial bore 52, also with radial play. The sealing element 44 and the swaging collar 45 can be braced inside the inner conductor by the contact part 41.

When screw 43 is tightened, its spherical surface 54 abuts the contact part 41 and also presses prongs 42, protruding from the end, radially against the sectional surface of the inner conductor 5. The contact part 41 must be able to move flexibly and adjust exactly to the angle of the sectional surface. For all sectional surfaces, a high contact force at preferably three points of contact is achieved. The bellows-shaped intermediate piece 25 engages the conical contact surfaces 55 under spring tension between the prongs 42 and adjusts to the tilt of the contact part 41 as a result of its mobility in all directions.

What is claimed is:

1. An apparatus for electrical connection of a hollow conductor (5) of a high frequency coaxial cable (1) with a conductor (14) of a coaxial connector (6), comprising:

a bellows-shaped intermediate piece (25) disposed between and electrically connecting the conductor (5) of the high frequency coaxial cable (1) and the conductor (14) of the coaxial connector (6).

2. An apparatus according to claim 1, wherein said intermediate piece (25) is axially compressible and connected to the conductor (5) of the coaxial cable (1) and the conductor (14) of the coaxial connector (6) at opposite axial ends of said intermediate piece.

3. An apparatus according to claim 1, wherein said intermediate piece (25) is spring-loaded in an axial direction in a compressed state.

4. An apparatus according to claim 1, wherein said intermediate piece (25) has an inwardly extending edge (27, 28) on at least one end.

5. An apparatus according to claim 1, wherein said intermediate piece (25) comprises a single, thin-walled piece.

6. An apparatus according to claim 1, wherein a hollow space (32) is defined by an inner circumferential wall of the inner conductor (5) of the coaxial cable (1), and a contact part (20) is disposed in the hollow space, and wherein said intermediate piece (25) electrically contacts said contact part, and the hollow space is sealed by said contact part and said intermediate piece.

7. An apparatus according to claim 6, further comprising a spreading part (23) for fixedly securing said contact part (20) to said inner conductor (5).

8. An apparatus according to claim 1, wherein the conductor (14) of the coaxial connector (6) is fixedly connected to said intermediate piece (25).

9. A coaxial cable assembly comprising:

a coaxial cable (1) comprising a hollow inner conductor (5);

a coaxial connector (6) comprising one of a female connector (14) and a connector pin;

an axially compressed, bellows-shaped intermediate piece (25) disposed between and electrically connecting said inner conductor (5) and said one of said female connector (14) and said connector pin of said coaxial connector (6); and a contact part (20) disposed inside said hollow inner conductor and having a conical contact surface (21), wherein one end of said intermediate piece (25) abuts against said conical contact surface (21).

10. A coaxial cable assembly according to claim 9, further comprising a tap (40) disposed inside said hollow inner conductor (5), and a movable contact part (41) disposed on an end of said tap projecting out of said hollow inner conductor (5).

11. A coaxial cable assembly comprising:

a coaxial cable (1) comprising a hollow inner conductor (5);

a coaxial connector (6) comprising one of a female connector (14) and a connector pin;

an axially compressed, bellows-shaped intermediate piece (25) disposed between and electrically connecting said inner conductor (5) and said one of said female connector (14) and said connector pin of said coaxial connector (6); and a tap (40) disposed inside said hollow inner conductor (5), and a movable contact part (41) disposed on an end of said tap projecting out of said hollow inner conductor (5), wherein said contact part (41) has a plurality of radially projecting prongs (42) which contact said hollow inner conductor (5) and said intermediate piece (25).

12. A coaxial cable assembly comprising:

a coaxial cable (1) comprising a hollow inner conductor (5);

a coaxial connector (6) comprising one of a female connector (14) and a connector pin;

an axially compressed, bellows-shaped intermediate piece (25) disposed between and electrically connecting said inner conductor (5) and said one of said female connector (14) and said connector pin of said coaxial connector (6); and a tap (40) disposed inside said hollow inner conductor (5), and a movable contact part (41) disposed on an end of said tap projecting out of said hollow inner conductor (5), wherein said tap (40) has a tightening screw (43) for compressing said contact part (41) against said inner conductor (5), said tightening screw (43) having a ball-shaped contact surface (54) which abuts said contact part when said screw is tightened.

13. An apparatus for electrical connection of a hollow conductor (5) of a high frequency coaxial cable (1) with a conductor (14) of a coaxial connector (6), comprising:

a bellows-shaped intermediate piece (25) disposed between and electrically connecting the conductor (5) of the high frequency coaxial cable (1) and the conductor (14) of the coaxial connector (6), wherein said intermediate piece (25) is axially compressible and connected to the conductor (5) of the coaxial cable (1) and the conductor (14) of the coaxial connector (6) at opposite axial ends of said intermediate piece, wherein said intermediate piece (25) comprises a single, thin-walled pipe having inwardly extending edges (27, 28) at said opposite axial ends, and wherein said intermediate piece (25) is spring-loaded in an axial direction in a compressed state, and said intermediate piece (25) is symmetric about a longitudinal axis of said intermediate piece, and hollow throughout between said inwardly extending edges.

* * * * *